US007168286B1

(12) United States Patent
Pelech

(10) Patent No.: US 7,168,286 B1
(45) Date of Patent: Jan. 30, 2007

(54) DEVICE AND METHOD FOR SECURING A PUNCH TOOL TO A RAM PORTION OF A PRESS BRAKE

(76) Inventor: Bruno J. Pelech, 17350 Antler Dr., Orland Park, IL (US) 60467

( * ) Notice: Subject to any disclaimer, the term of this patent is extended or adjusted under 35 U.S.C. 154(b) by 0 days.

(21) Appl. No.: 11/261,301

(22) Filed: Oct. 29, 2005

(51) Int. Cl.
*B21D 37/04* (2006.01)
*B21J 9/02* (2006.01)

(52) U.S. Cl. ..... 72/482.92; 72/481.1; 72/389.3

(58) Field of Classification Search ..... 72/389.3, 72/481.1, 481.7, 481.8, 482.92, 482.94
See application file for complete search history.

(56) References Cited

U.S. PATENT DOCUMENTS 3,681,994 A * 8/1972 Zbornik ..... 72/389.3
4,895,014 A * 1/1990 Houston ..... 72/481.2
5,245,854 A * 9/1993 Bruggink et al. ..... 72/481.7
6,494,075 B1 * 12/2002 Pelech, Jr. ..... 72/481.1
6,516,649 B1 * 2/2003 Mika et al. ..... 72/482.92
6,644,091 B2 * 11/2003 Huang et al. ..... 72/481.1

OTHER PUBLICATIONS

Wila USA Catalog—p. 19.

* cited by examiner

*Primary Examiner*—David B. Jones
(74) *Attorney, Agent, or Firm*—Cherskov & Flaynik

(57) ABSTRACT

A device (10) for securing a punch tool (6) to a ram portion (8) of a press brake includes an upper portion (12) having opposing front and back outer recesses (14) and (15) extending longitudinally from a first end wall (16) to a second end wall (18), the outer recesses (14) and (15) being configured to snugly receive a corresponding inner wall (20) protuberance (22) of a clamp portion (21) of the ram portion (8) of the press brake as the upper portion (12) is grasped and "squeezed" by the ram portion (8) during operation of the press brake. The device (10) and the punch tool (6) attached thereto, are supported by the protuberance (22). A lower portion (24) of the device (10) includes an inner recess (26) that snugly receives a corresponding upper portion (28) of the punch tool (6). The upper portion (28) of the punch tool (6) is removably secured to the lower portion (24) of the device (10) thereby promoting the quick substitution of punch tools (6) having varying lower portion (52) configurations and identical upper portion (28) configurations.

16 Claims, 8 Drawing Sheets

DEVICE AND METHOD FOR SECURING A PUNCH TOOL TO A RAM PORTION OF A PRESS BRAKE

BACKGROUND OF THE INVENTION

1. Field of the Invention

The present invention relates to press brakes for deforming workpieces into predetermined configurations, and more particularly, to devices and methods that secure a relatively old designed punch tool to a relatively new designed ram portion of a press brake.

2. Background of the Prior Art

Press brake machines and their operative components that are utilized to deform workpieces into predetermined configurations are well known to those of ordinary skill in the art. Typically, a workpiece is disposed between a punch tool and a die, the press brake then forcibly urges the punch tool vertically downward into engagement with the workpiece until the workpiece congruently engages both the punch tool and the die thereby deforming the workpiece into a predetermined configuration consistent with the configurations of the punch tool and the die. An upper end of the punch tool is secured to a ram portion of the press brake and the die is secured in a portion of the press brake opposite to the ram portion. A typical punch tool is manufactured by Wila USA, 9135 Guilford Road, Columbia, Md. 21046. Punch tools and dies can be relatively long and expensive portions of tool steel. Further, a myriad of punch tools and dies of varying configurations are required with each press brake to correspondingly bend workpieces into predetermined configurations.

A problem occurs when the ram portion of the press brake is improved, replaced, revised or retrofitted such that the upper portion of existing punch tools is no longer capable of being secured to and supported by the ram portion. The ram portion will then require all new punch tools with the same lower portions as the existing punch tools, but with reconfigured upper portions that removably secure to the new ram portion. The old punch tools become obsolete pieces of expensive tool steel.

A need exists for a device that is capable of securing old obsolete punch tools to a new ram portion of a press brake. Further, the device must be relatively inexpensive, and easily and quickly secured to both the ram portion and a punch tool. Also, should multiple punch tools with varying upper portion configurations be encountered, the device must be capable of being reproduced in sufficient quantity such that each of the reproduced devices has an upper portion configuration that removably secures to the ram portion, and each of the reproduced devices has a unique lower portion configuration that removably secures to one of the upper portion configurations of the multiple punch tools. Thus, an unique lower portion of the device is provided for each of the multiple punch tools. Ultimately, one device is provided for each unique upper portion of the punch tools thereby allowing all once obsolete punch tools to be utilized with a new ram portion of the press brake.

SUMMARY OF THE INVENTION

It is an object of the present invention to overcome many of the disadvantages associate with securing a punch tool to a ram portion of a press brake.

A principle object of the present invention is to provide a device that secures a relatively old punch tool design to a relatively new ram portion design of a press brake. A feature of the device is an upper portion configured to snugly insert into a recess in a ram portion of a press brake. Another feature of the device is a pair of opposing outer recesses longitudinally extending from a first end wall to a second end wall of the device; the outer recesses being configured to allow either outer recess to snugly receive a corresponding inner wall protuberance of a clamp portion of the ram portion such that the device is supported by the ram portion. An advantage of the device is that the upper portion of the device is easily and quickly secured to the ram portion irrespective of the first or second end wall of the device being inserted first into the ram portion.

Another object of the present invention is to provide a device that promotes a quick securing of a punch tool to the device. A feature of the device is a lower portion integrally joined to the upper portion. Another feature of the device is a lower portion with horizontal apertures that ultimately align with apertures in an upper portion of the punch tool, the aligned apertures receiving a support rod therethrough. An advantage of the device is that the punch tool is easily separated from the device by manually removing the support rods. Another advantage of the device is that the position of the punch tool is maintained relative to the ram portion irrespective of the force generated by the press brake upon the punch tool when the punch tool engages and bends a workpiece disposed between the punch tool and a cooperating die.

Still another object of the present invention is to provide a device that promotes safety when securing the device to the punch tool. A feature of the device is a longitudinally extending recess in the lower portion, the recess being configured to snugly receive a top portion of the punch tool. Another feature of the device is a plurality of substantially vertical apertures through the upper portion that are ultimately aligned with cooperating threaded vertical recess in the upper portion of the punch tool, the aligned apertures and recesses receiving a support bolt or screw that is flush or countersunk to a top wall of the device. An advantage of the device is that the "grasp" of the device upon the punch tool is increased thereby better maintaining the position of the punch tool relative to the ram portion of the press brake irrespective of the weight of punch tool.

Yet another object of the present invention is to provide a method for securing one of a plurality of punch tools to a ram portion of a press brake. A feature of the method is to provide an upper member dimensioned and configured to snugly insert into a recess in the ram portion of the press brake. Another feature of the method is to provide lower members dimensioned and configured to snugly receive varying top portions of punch tools. An advantage of the method is that multiple punch tools having varying configurations are quickly substituted in a press brake to deform multiple workpieces with varying configurations.

Another object of the present invention is to support the device and the punch tool secured thereto after a ram portion of the press brake releases an upper portion of the device. A feature of the device are support rods extending past front and back side walls of a lower portion of the device. Another feature of the device is engaging end portions of the support rods with bottom walls of opposing recesses in the ram portion of the press brake after the ram portion releases the upper portion of the device. An advantage of the device is the prevention of injury to an operator and the prevention of damage to the device and attached punch tool.

Briefly, the invention provides a device for securing a punch tool to a ram portion of a press brake comprising an upper portion having opposing outer recesses extending longitudinally from a first end wall to a second end wall, said outer recesses being configured to snugly receive a corresponding inner wall protuberance of a clamp portion of the ram portion such that said device is supported by the ram portion; a lower portion having an inner recess extending longitudinally from said first end wall to said second end wall, said inner recess being configured to snugly receive a corresponding upper portion of the punch tool; and means for securing said lower portion to the upper portion of the punch tool.

The invention further provides a method of securing one of a plurality of punch tools to a ram portion of a press brake, said method comprising the steps of providing an upper member having an outer recess extending longitudinally upon a side wall, said outer recess snugly receiving a corresponding inner wall protuberance of a clamp portion of the ram portion of the press brake such that said upper member is supported by the ram portion; providing a lower member having an inner recess extending longitudinally through said lower member, said inner recess snugly receiving a corresponding upper portion of the one of the plurality of punch tools; joining said upper member to said lower member; and securing said lower member to the upper portion of the punch tool.

The invention further provides a device for joining a punch tool to a press brake comprising means for securing an upper portion of said device to a ram portion of the press brake; means for securing a lower portion of said device to the punch tool; and means for supporting said lower portion via the ram portion of the pres brake after the ram portion releases said upper portion.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
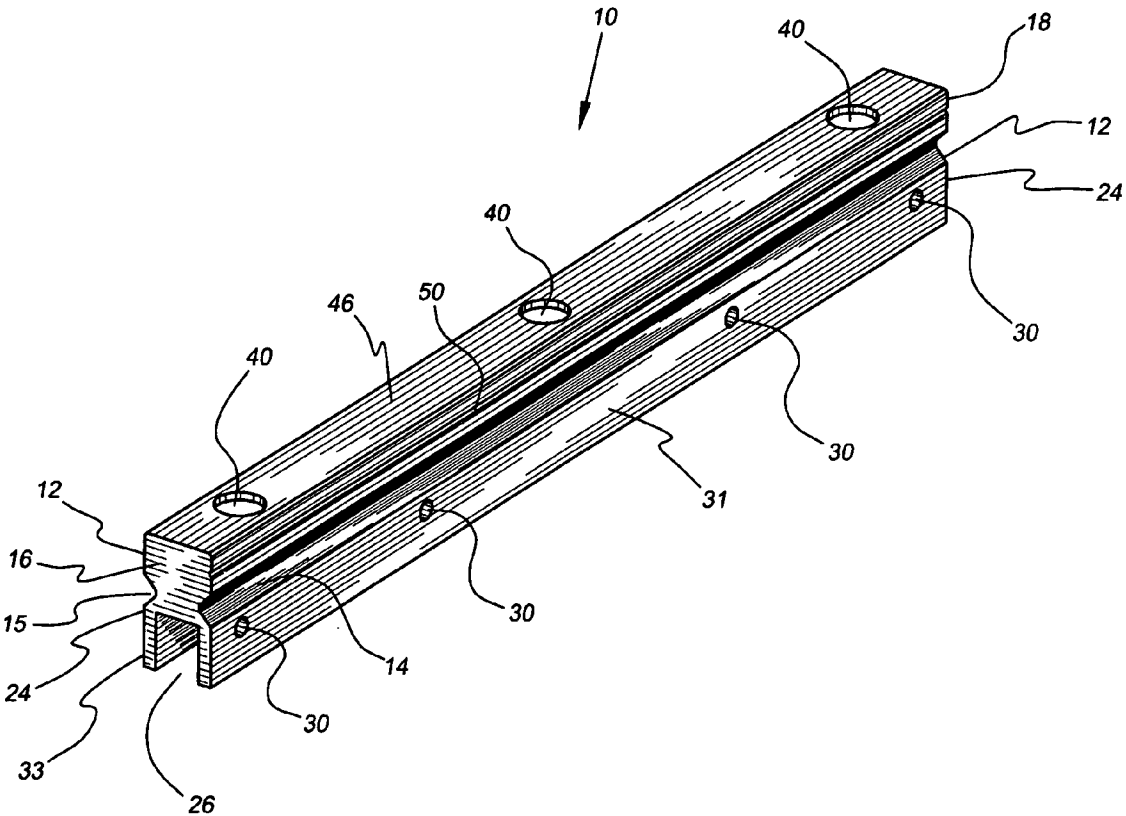
FIG. 1 is a front perspective view of a device for securing a punch tool to a ram portion of a press brake without depicting support rods or support bolts in accordance with the present invention.

Referring now to drawings 1–9, a device for securing a typical punch tool 6 to a ram portion 8 of a press brake (not depicted) in accordance with the present invention is denoted as numeral 10. The device 10 is a solid piece of cast metal, preferably tool steel, and includes an upper portion 12 having opposing front and back symmetrical outer recesses 14 and 15 extending longitudinally from a first end wall 16 to a second end wall 18, the outer recesses 14 and 15 being configured to snugly receive a corresponding inner wall 20 protuberance 22 of a clamp portion 21 of the ram portion 8 of the press brake. The device 10 snugly inserts, via the first or second end walls 16 and 18, into a cooperating recess 23 in the ram portion 8 such that the device 10, and the punch tool 6 removably attached thereto, are supported by the protuberance 22 of the clamp portion 21 of the ram portion 8 after the press brake grasps and "squeezes" the ram portion 8, thereby urging the protuberance 22 of the clamp portion 21 into one of the recesses 14 and 15 whereupon the operation of the press brake is initiated to deform a workpiece into a preselected configuration.

The device 10 further includes a lower portion 24 having an inner recess 26 extending longitudinally from the first end wall 16 to the second end wall 18, the inner recess 26 being configured to snugly receive a corresponding upper portion 28 of the punch tool 6. Typically, the inner recess is substantially "U" configured when taking a side elevation view of the device 10. The lower portion 24 includes a plurality of apertures 30 through front and back planar side walls 31 and 33 of the lower portion 24 that are ultimately aligned with cooperating apertures 32 through a side portion 34 of the upper portion 28 of the punch tool 6. The aligned apertures 30 and 32 snugly receive a cylindrical support rod 38 therethrough that maintains the position of the punch tool 6 relative to the ram portion 8 irrespective of the force generated by the press brake upon the punch tool 6 when the punch tool 6 engages and bends a workpiece (not depicted) disposed between the punch tool 6 and a cooperating die (not depicted).

The support rods 38 are fabricated from hardened steel dowel pins and are longitudinally dimensioned to allow opposing end portions 39 to extend slightly past the front and back side walls 31 and 33 of the lower portion 24 to promote the manual removal of the support rods 38 from the lower portion 24 and the fast replacement of punch tools 6 having varying lower portion 52 configurations and identical upper portion 28 configurations. Further, the longitudinal and lateral dimensions of the support rods 38 promote the slidable insertion of the support rods 38 into opposing rod recesses 41 in the ram portion 8 such that a relatively small gap 43 forms between the rods 38 and corresponding portions of the ram portion 8. The extension of the end portions 39 of the rods 38 into the recesses 41 of the ram portion 8 facilitates the supporting of the device 10 and the punch tool 6 by the ram portion 8 after the clamp portion 21 of the ram portion 8 releases the device 10 by retracting the protuberance 22 of the clamp portion 21 from one of the outer recesses 14 and 15 in the upper portion 12 of the device 10. The gap 43 is dimensioned such that the support rods 38 engage the ram portion 8 only when the clamp portion 21 releases the device thereby allowing the device 10 to drop until the support rods 38 engage bottom gap walls 45 of the ram portion recesses 41, whereupon, the device 10 and the punch tool 6 removably secured thereto may be horizontally slid from the ram portion 8 by an operator while the support rods 38 rotationally engage the bottom gap walls 45 thereby preventing injury to the operator and preventing damage to the device 10 and punch tool 6.

To provide added safety when securing the punch tool 6 to the device 10, the upper portion 12 includes a plurality of substantially vertical apertures 40 therethrough that are ultimately aligned with cooperating threaded vertical recess 42 in the upper portion 28 of the punch tool 6, the aligned apertures 40 and recesses 42 receive a support bolt or screw 44 that maintains the position of the punch tool 6 relative to the device 10. The support bolt or screw 44 is countersunk relative to a top wall 46 of the upper portion 12 thereby providing a substantially planar top wall 46 that cooperates with an outer configuration of the upper portion 12 to promote a snug insertion of the upper portion 12 into a corresponding recess 23 in the ram portion 8 of the press brake. The top wall 46 of the upper portion 12 and a corresponding top wall 48 in the recess 23 in the ram portion 8 form a gap 49 that prevents force from being transferred from the ram portion 8 to the device 10. Thus, all pressing force is transferred from the ram portion 8 to the punch tool 6 via cooperating engagement portions 54 and 56 thereby preventing damage to the device 10. The pressing force ultimately urges the punch tool 6 into forcible engagement with a workpiece disposed upon a die which is supported by a corresponding portion of the press brake. The upper portion 12 further includes an optional second outer recess 50 extending longitudinally from the first end wall 16 to the second end wall 18 to indicate a front side of the device 10, although both longitudinal (front or back) side walls of the device 10 provide a recess 14 and 15 to receive the protuberance 22 of the clamp 21 portion thereby reducing the possibility of operator error by allowing the operator to insert either the first or second end walls 16 and 18 into the recess 23 in the ram portion 8.

Figure 2:
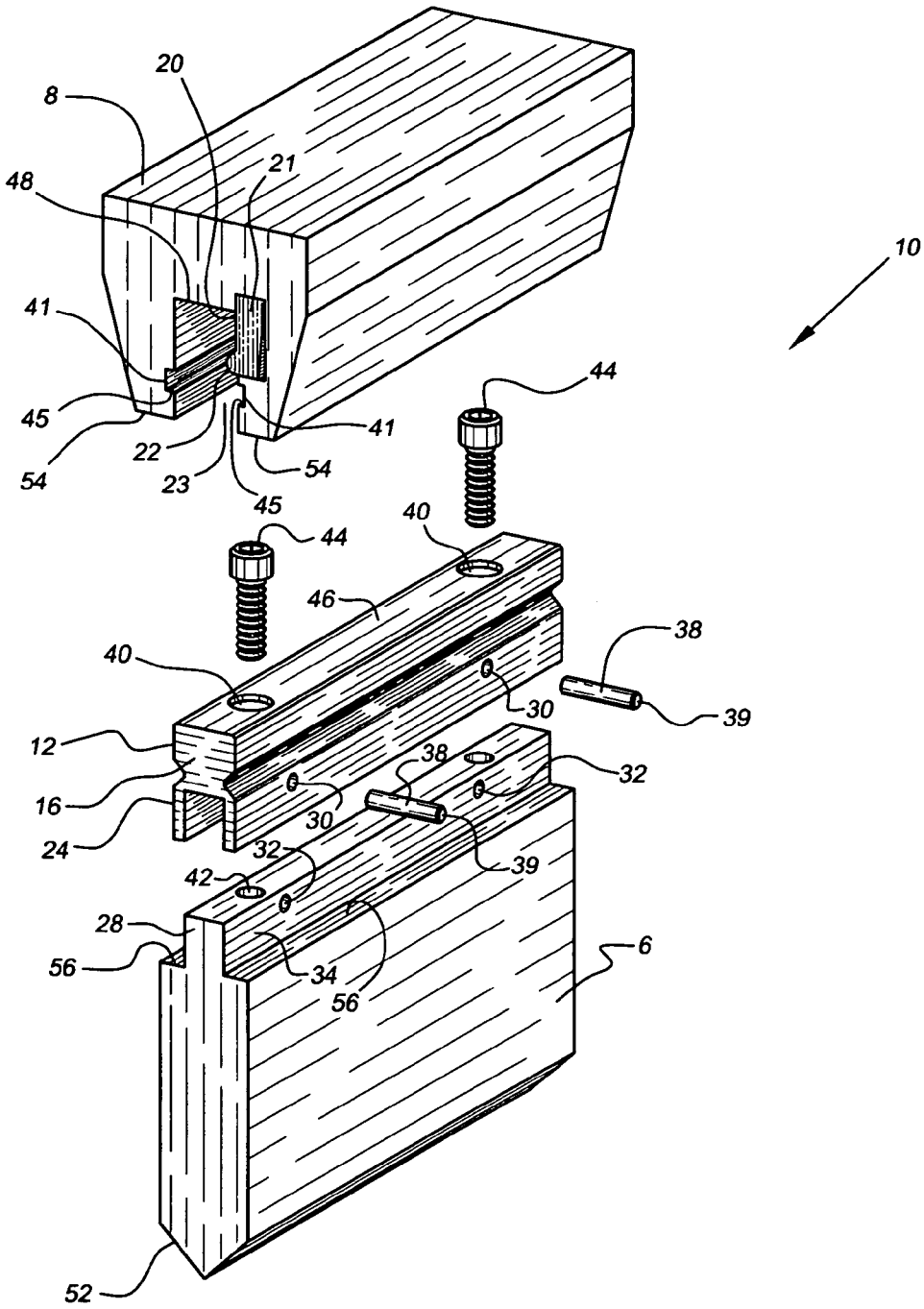
FIG. 2 is an exploded perspective view of the device of FIG. 1 with support rods and support bolts added in accordance with the present invention, and depicting a punch tool and ram portion of a press brake.
Figure 3:
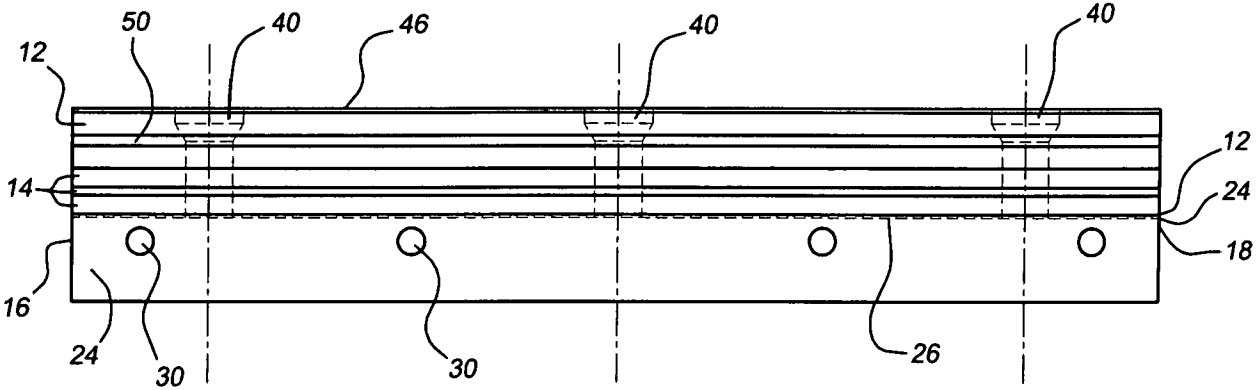
FIG. 3 is a front elevation-phantom view of the device of FIG. 1.
Figure 4:
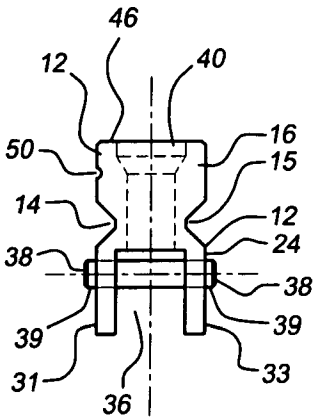
FIG. 4 is a side elevation-phantom view of the device of FIG. 3 with support rods added in accordance with the present invention.
Figure 5:
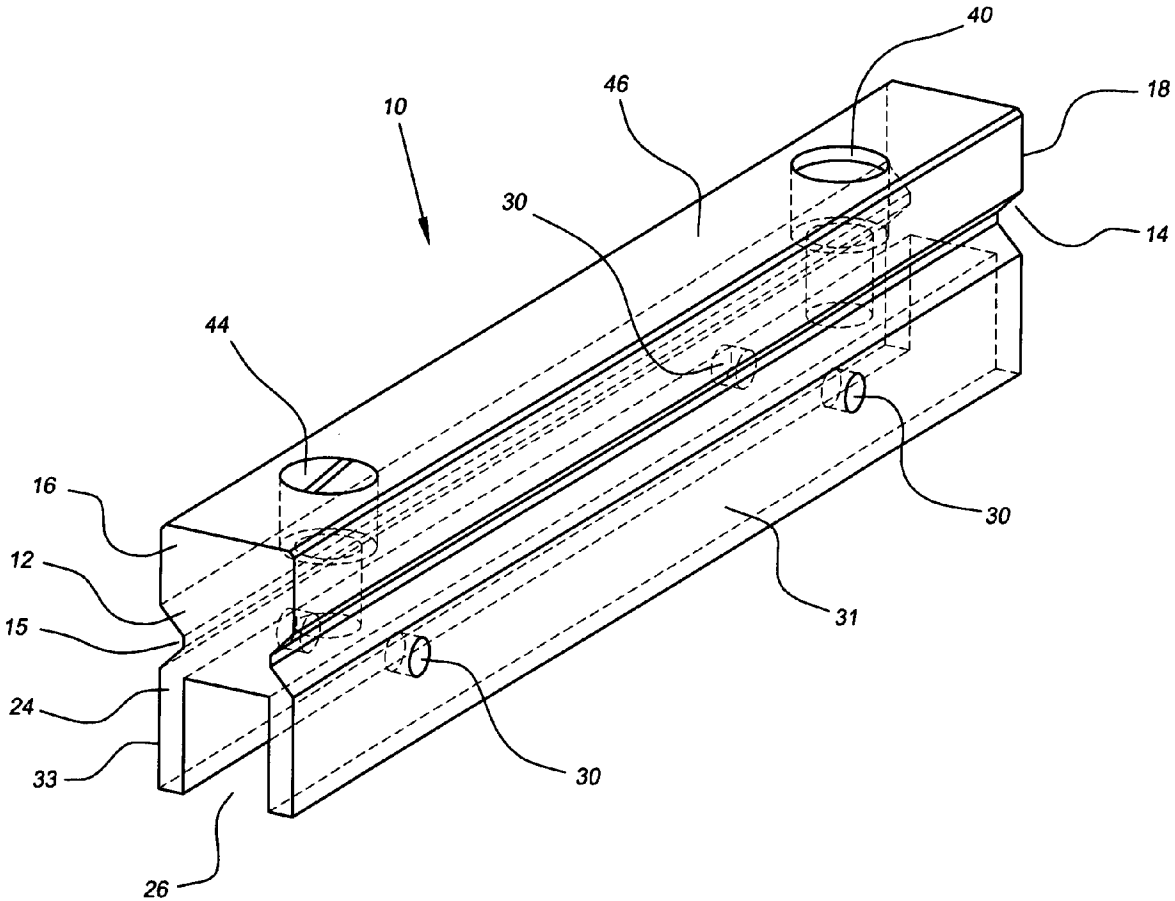
FIG. 5 is a perspective-phantom view of the device of FIG. 1.
Figure 6:
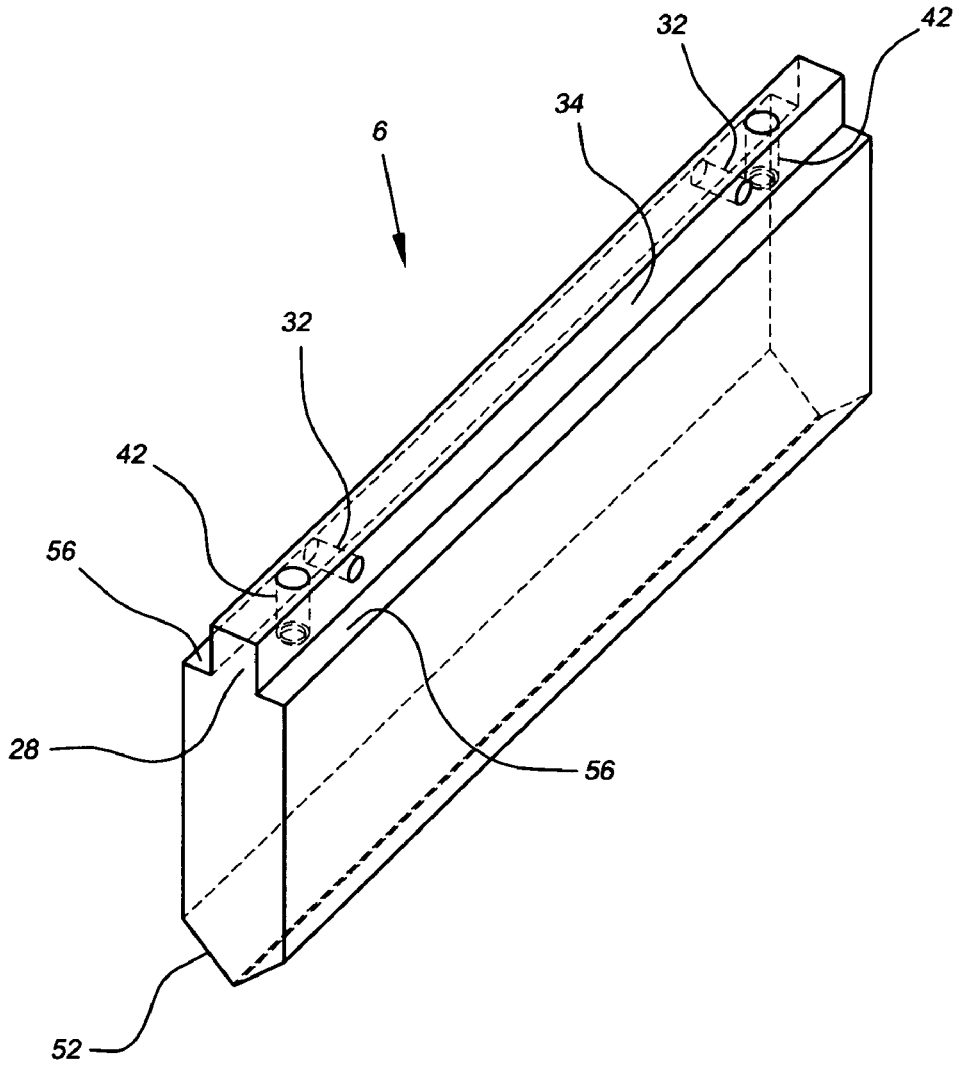
FIG. 6 is a perspective-phantom view of the punch tool of FIG. 2.
Figure 7:
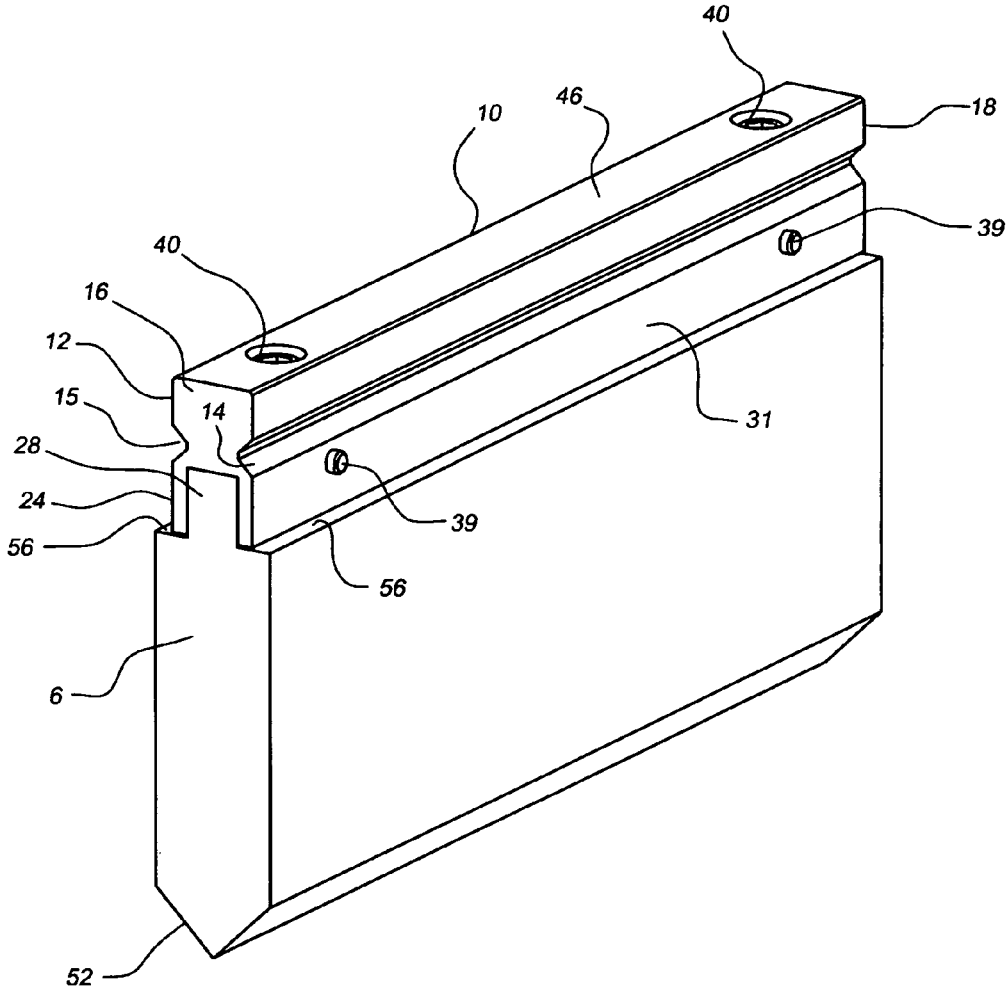
FIG. 7 is a perspective view of the device disposed upon an upper portion of a punch tool in accordance with the present invention.
Figure 8:
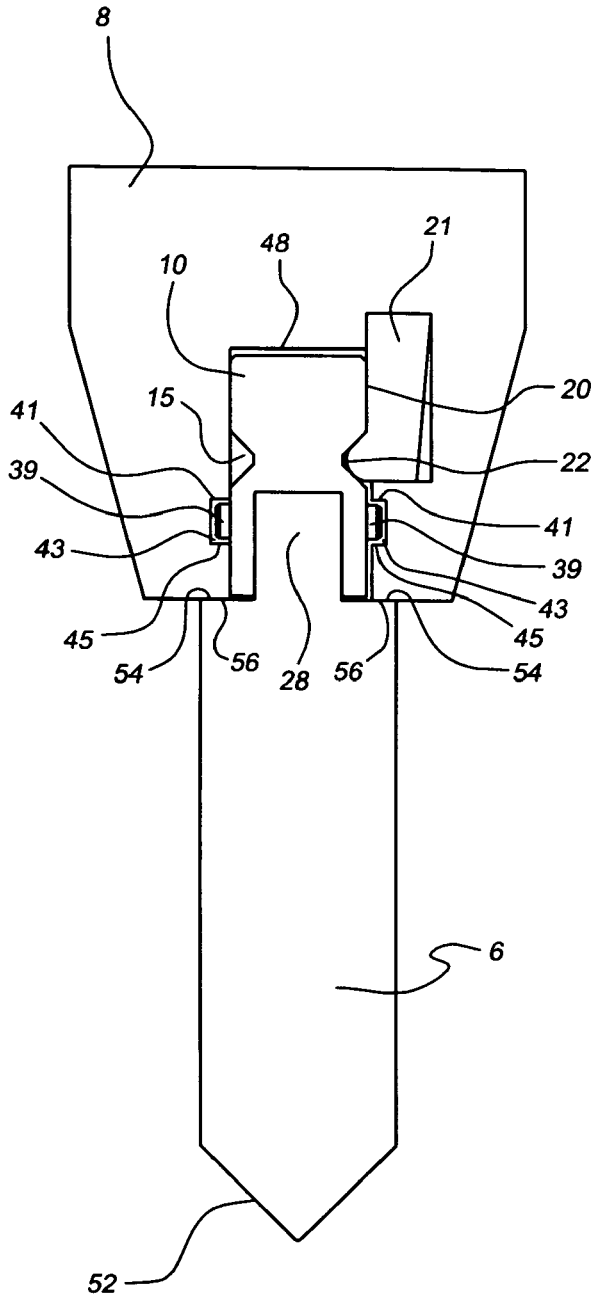
FIG. 8 is a side elevation view of the device secured to the punch tool, and the device inserted into and secured to a ram portion of a press brake in accordance with the present invention.
Figure 9:
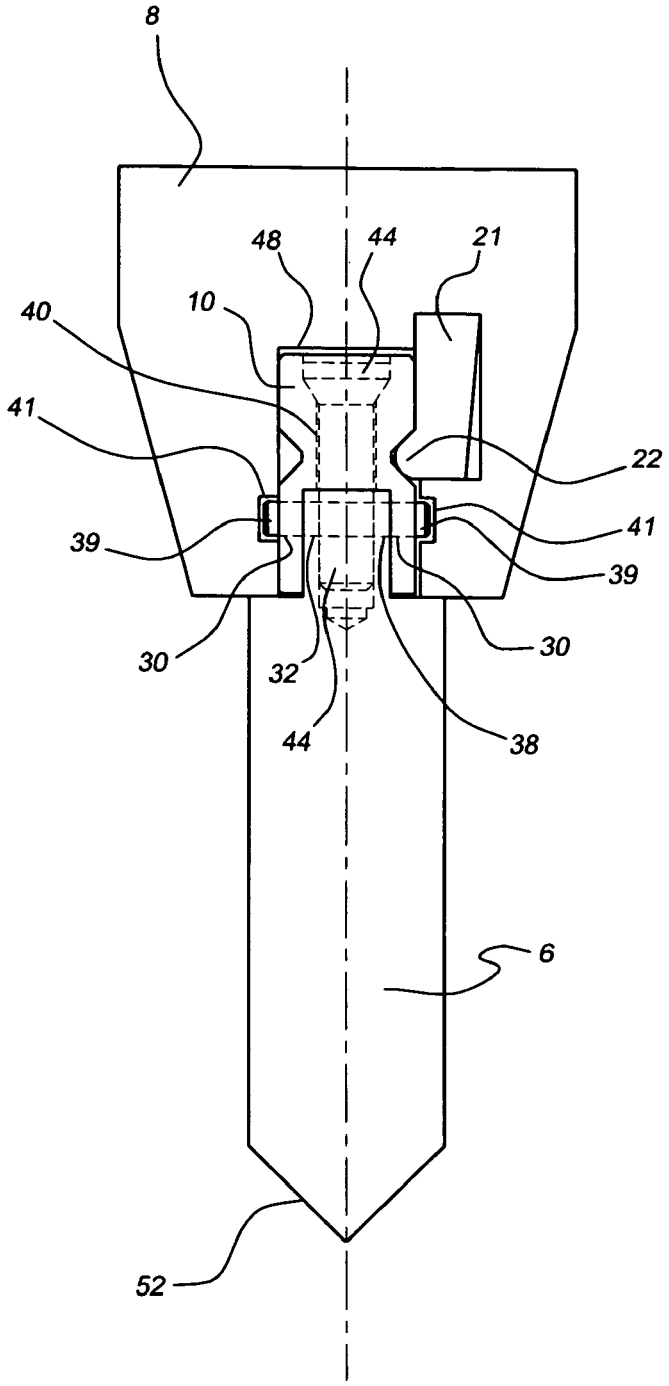
FIG. 9 is a phantom-side view of the device of FIG. 8, the device being secured to the punch tool and inserted into and secured to the ram portion of the press brake.

The lower portion 24 includes an outer configuration that promotes a snug insertion of the lower portion 24 into the recess 23 in the ram portion 8 of the press brake. The apertures 40 in the upper portion 12 and the apertures 30 in the lower portion 24 are alternately disposed and spaced substantially constant between the first and second end walls 16 and 18 of the device 10 (see FIG. 1). Alternatively, the apertures 30 and 40 may be disposed proximate to the first and second end walls 16 and 18 (see FIG. 2).

Generally, a fabrication shop can afford only one press brake to form workpieces into a myriad of configurations, the workpiece configurations corresponding to a lower portion 52 of the punch tool 6 and cooperating portion of the die. Thus, the configuration and dimensions of the upper portions 12 of multiple devices 10 remain constant due to the device 10 being used with only one press brake. If multiple press brakes with varying ram configurations were present in the fabrication shop, then multiple devices 10 with varying upper portion 12 configurations would be required. Further, the configurations and dimensions of the lower portions 24 will correspondingly vary with configurations of the upper portions 28 of the punch tools 6 selected to form or bend multiple workpiece into varying predetermined configurations. Therefore, for each varying upper portion 28 of the punch tool 6, a corresponding lower portion 24 of the device 10 is required to promote the securing of the punch tool 6 to the ram portion 8 of the press brake.

In operation, a punch tool 6 and corresponding die are selected to deform a workpiece into a preselected configuration. The selected die is disposed upon a lower portion (not depicted) of the press brake. One of a plurality of securing devices 10 is selected with a lower portion that includes a recess 26 configured to snugly receive an upper portion 28 of the selected punch tool 6. The upper portion 28 of the punch tool 6 is then secured to the lower portion 24 of the selected device 10 via cylindrical support rods 38 that insert through aligned apertures 30 and 32 in the lower portion 24 and the upper portion 28 of the punch tool 6. For added safety, support bolts or screws 44 are rotationally inserted through aligned apertures 40 and recesses 42 in cooperating upper portions 12 and 28 such that the exposed surfaces of the bolts or screws 44 are flush or countersunk with the top wall 46 of the upper portion 12.

The upper portion 12 is then inserted into a recess 23 in the ram portion 8 of the press brake where an inner wall protuberance 22 cooperates with one of the outer recesses 14 and 15 to support the upper portion 12 and the punch tool 6 secured to the lower portion 24. A workpiece is then disposed between the lower portion 52 of the punch tool 6 and the die. The press brake is then operated to press the workpiece into a predetermined configuration consistent with the configurations of the lower portion 52 of the punch tool 6 and the die.

Upon completing the deformation of all workpieces with the selected punch tool 6 and die, the securing device 10 is manually removed from the ram portion 8, then the support rods 38 are manually removed from the lower portion 24 and the support bolts or screws 44 are manually removed from the upper portion 12 thereby allowing the punch tool 6 to be separated from the lower portion 24. A replacement punch tool 6 is then connected to the lower portion 24 and the device 10 is reinserted into the ram portion 8. A replacement die is then disposed upon the lower portion of the press brake, a workpiece is then positioned between the punch tool 6 and die, whereupon, the workpiece is forcibly deformed into a configuration corresponding to the lower portion 52 of the punch tool 6 and the replacement die.

After all workpieces have been deformed via a first punch tool 6 secured to a first dedicated device 10, a second punch tool 6 connected to the lower portion 24 of a second dedicated device 10 replaces the first punch tool 6 in the ram portion 8. The press brake is again operated to forcibly urge the second punch tool 6 against a workpiece to deform the workpiece into a configuration different from the first set of workpieces.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for securing a punch tool to a ram portion of a press brake comprising:

an upper portion having opposing outer recesses extending longitudinally from a first end wall to a second end wall, said outer recesses being configured to snugly receive a corresponding inner wall protuberance of a clamp portion of the ram portion such that said device is supported by the ram portion;

a lower portion having an inner recess extending longitudinally from said first end wall to said second end wall, said inner recess being configured to snugly receive a corresponding upper portion of the punch tool, said lower portion including means for supporting said lower portion and the punch tool via the ram portion of the press brake after the ram portion releases said upper portion; and means for securing said lower portion to the upper portion of the punch tool.

2. The device of claim 1 wherein said upper portion includes a second outer recess extending longitudinally from said first end wall to said second end wall to provide an indication of a front side of said device.

3. The device of claim 1 wherein said upper portion includes an outer configuration that promotes a snug insertion of said upper portion into a corresponding recess in the ram portion of the press brake.

4. The device of claim 1 wherein said lower portion includes an outer configuration that promotes a snug insertion of said lower portion into a corresponding recess in the ram portion of the press brake.

5. The device of claim 1 wherein said lower portion securing means includes a plurality of apertures through said lower portion that are ultimately aligned with cooperating apertures through a side portion of the punch tool, said aligned apertures receiving a support rod therethrough that maintains the position of the punch tool relative to the press brake.

6. The device of claim 1 wherein said lower portion support means includes opposing end portions of a support rod extending beyond side portion walls of the punch tool.

7. The device of claim 6 wherein said end portions of said support rod engage cooperating bottom walls of opposing recesses in the ram portion.

8. A device for securing a punch tool to a ram portion of a press brake comprising:

an upper portion having opposing outer recesses extending longitudinally from a first end wall to a second end wall, said outer recesses being configured to snugly receive a corresponding inner wall protuberance of a clamp portion of the ram portion such that said device is supported by the ram portion, said upper portion including means for securing said upper portion to a punch tool, said upper portion securing means including a plurality of substantially vertical apertures therethrough that are ultimately aligned with cooperating threaded vertical recesses in an upper portion of the punch tool, said aligned apertures and recesses receiving a support bolt that maintains the position of the punch tool relative to the press brake;

a lower portion having an inner recess extending longitudinally from said first end wall to said second end wall, said inner recess being configured to snugly receive a corresponding upper portion of the punch tool; and means for securing said lower portion to the upper portion of the punch tool.

9. A method of securing one of a plurality of punch tools to a ram portion of a press brake, said method comprising the steps of:

providing an upper member having an outer recess extending longitudinally upon a side wall, said outer recess snugly receiving a corresponding inner wall protuberance of a clamp portion of the ram portion of the press brake such that said upper member is supported by the ram portion;

providing a lower member having an inner recess extending longitudinally through said lower member, said inner recess snugly receiving a corresponding upper portion of the one of the plurality of punch tools; and securing said lower member to the upper portion of the punch tool, the step of securing said lower member to the upper portion of the punch tool including the step of providing support rods having end portions extending past front and back side walls of said lower member.

10. The method of claim 9 wherein the step of providing an upper member includes the step of securing said upper member to an upper portion of the punch tool.

11. The method of claim 10 wherein the step of securing said upper member to an upper portion of the punch tool includes the step of providing a plurality of substantially vertical apertures through said upper member that are ultimately aligned with cooperating threaded vertical recesses in the upper portion of the punch tool, said aligned apertures and recesses receiving a support bolt that maintains the position of the punch tool relative to the press brake.

12. The method of claim 9 wherein the step of providing an upper member includes the step of indicating a front side of said device.

13. The method of claim 9 wherein the step of providing an upper member includes the step of providing an outer configuration that promotes a snug insertion of said upper member into a corresponding recess in the ram portion of the press brake.

14. The method of claim 9 wherein the step of providing a lower member includes the step of providing an outer configuration that promotes a snug insertion of said lower member into a corresponding recess in the ram portion of the press brake.

15. The method of claim 9 wherein the step of securing said lower member to the upper portion of the punch tool includes the step of providing a plurality of substantially horizontal apertures through said lower member that are ultimately aligned with cooperating horizontal apertures through a side portion of the punch tool, said aligned apertures receiving a support rod therethrough that maintains the position of the punch tool relative to the press brake.

16. The method of claim 9 wherein the step of providing support rods includes the step of engaging said end portions of said support rods with bottom walls of opposing recesses in the ram portion of the press brake after the ram portion releases said upper member of said device.

* * * * *